United States Patent [19]

Kutcher

[11] Patent Number: 4,540,101

[45] Date of Patent: Sep. 10, 1985

[54] CONTAINER ASSEMBLY INCLUDING A TAMPER-INDICATING BAND

[75] Inventor: Howard R. Kutcher, Allison Park, Pa.

[73] Assignee: Aluminum Company of America, Pittsburgh, Pa.

[21] Appl. No.: 545,444

[22] Filed: Oct. 26, 1983

[51] Int. Cl.[3] ..... B65D 41/34

[52] U.S. Cl. ..... 215/252

[58] Field of Search ..... 215/252; 206/627, 620

[56] References Cited

U.S. PATENT DOCUMENTS

| | | | |
|---|---|---|---|
| 2,361,449 | 10/1944 | Benzinger | 215/38 |
| 2,361,464 | 10/1944 | Edwards et al. | 215/38 |
| 3,088,830 | 5/1963 | Graham | 99/171 |
| 3,339,820 | 9/1967 | Krzyzanowski | 206/620 X |
| 3,343,746 | 9/1967 | Shiffman | 206/627 X |
| 3,455,479 | 7/1969 | Hadley et al. | 215/252 |
| 3,951,292 | 4/1976 | Amberg | 215/230 |
| 4,153,174 | 5/1979 | Keeler | 215/252 |

FOREIGN PATENT DOCUMENTS

| | | | |
|---|---|---|---|
| 5596 | of 1913 | United Kingdom | 215/252 |

*Primary Examiner*—Donald F. Norton

*Attorney, Agent, or Firm*—Glenn E. Klepac

[57] ABSTRACT

A container assembly comprising a container, a closure covering an opening of the container and including a skirt, and a tamper-indicating band overlying the skirt and fastened to the container. The band comprises an array of obliquely slanted score lines spaced apart from one another. The score lines define a plurality of obliquely slanted, fracturable strips. Removal of the closure from the container involves grasping the band and manually twisting, thereby breaking or visibly distorting at least one of the strips.

17 Claims, 6 Drawing Figures

CONTAINER ASSEMBLY INCLUDING A TAMPER-INDICATING BAND

FIELD OF THE INVENTION

The present invention relates to container closures and to container assemblies having features providing evidence of tampering with a closure mechanism after such tampering has occurred.

BACKGROUND OF THE INVENTION

Tamper-indicating devices for containers are known in the prior art. However, each of these prior art devices has suffered from one or more serious disadvantages making it less than entirely suitable for its intended purpose.

For example, U.S. Pat. Nos. 2,361,449; 2,361,464; and 3,088,830 each disclose a container provided with a band formed with a series of horizontally-extending openings. These openings form an array extending circumferentially around the container. The horizontal array of openings is situated just below a lower edge of the container closure.

A different type of pilfer-resistant device comprises an encircling element of shrunken plastic material covering a skirt portion of the container closure and a neck of the container. One such device is disclosed in U.S. Pat. No. 3,951,292.

These prior art devices generally increase the difficulty of opening a protected container. However, in some cases, the devices may cause the containers to be so difficult to open as to discourage purchase by consumers. In addition, these devices generally do not provide a very sensitive indication of pilferage.

It is a principal objective of the present invention to provide a container assembly including a band that is a sensitive visual indicator of any attempt at pilferage.

It is a related object of the invention to provide a tamper-indicating band that is attractive in appearance and that does not cause any undue difficulty in removing a closure from the container.

A further object of the invention is to provide a tamper-indicating band that is suitable for application to containers at production speeds.

Additional objects and advantages of the invention will be apparent to persons skilled in the art from the following description and drawings.

SUMMARY OF THE INVENTION

The present invention can be summarized as being a container assembly comprising a container having a neck including an upper finish portion, a closure including a skirt engaging the finish portion, and a tamper-indicating band having an upper portion overlying at least a portion of the skirt and a lower portion fastened to the container. The tamper-indicating band comprises an array of obliquely slanted score lines defining a plurality of slanted fracturable strips. Any attempt at opening the container requires distortion or breakage of these strips. Accordingly, the tamper-indicating band provides a sensitive visual indicator of any attempt at tampering or pilferage.

In its broader aspects, the present invention is also directed to a novel tamper-indicating band. The preferred band of the invention is generally rectangular and has an array of score lines extending in a generally latitudinal direction across the band. Preferably, the score lines are generally parallel to one another and are separated by a substantially constant distance. Although a preferred band is made from paper, the band may also be manufactured using other materials selected from the group consisting of plastics, metal, aluminum foil and foil-covered paper.

When the band is intended for use on a cyclindrical container having a closure that is opened by rotation in a counterclockwise direction, lower ends of the score lines are spaced rightwardly or counterclockwise from the upper ends. Score lines extending through the entire thickness of the band are preferred, although partial score lines are also within the scope of the invention.

DETAILED DESCRIPTION OF A PREFERRED EMBODIMENT

Figure 1:
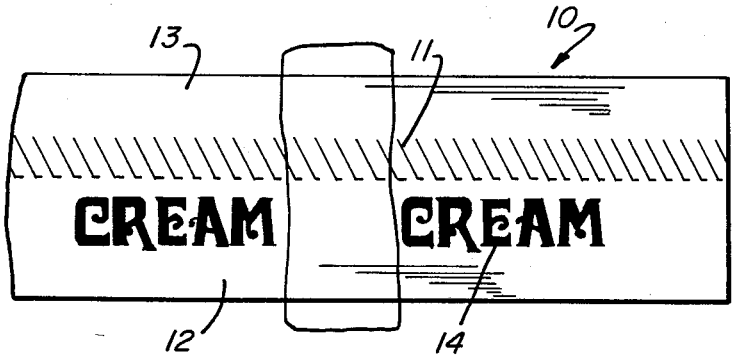
FIG. 1 is a plan view of a preferred tamper-indicating band of the invention.

A preferred tamper-indicating band of the invention is shown in FIG. 1. The preferred band 10 is generally rectangular and includes a generally latitudinal array of score lines extending across the entire length of the band 10. The array 11 divides the band 10 into a proximal or lower portion 12 and an upper or distal portion 13.

The band 10 of the invention is intended for use as a primary or secondary package label in addition to performing a tamper-indicating function. When the band 10 is a primary label, it will include imprinted product identification indicia 14, as shown in FIG. 1. The band 10 may also comprise other printed matter promoting the sale of a product.

Figure 2:
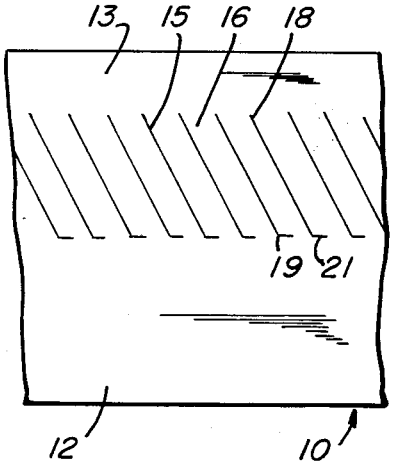
FIG. 2 is an enlarged, fragmentary view of the circled portion of FIG. 1.

The band 10 illustrated is preferably made of paper. The band 10 may also be made from other packaging materials such as plastic, metal, aluminum foil and foil-covered paper. As shown in FIGS. 1 and 2, the score lines 15 are obliquely slanted and spaced apart from one another. The preferred score lines are generally parallel to one another and are separated by a substantially constant distance of about 2 mm. The spacing between score lines may vary, although spacings of less than about 5 mm are preferred.

The score lines 15 define a plurality of obliquely slanted fracturable strips 16 extending between the proximal portion 12 and distal portion 13 of the band 10. It is an important feature of the invention that these strips 16 are usually broken or fractured when torque is applied to the band 10.

In the preferred band 10 illustrated, each of the score lines 15 includes an upper end 18 and a lower end 19 spaced downwardly and rightwardly from the upper end 18. The score lines 15 are preferably slanted in the direction indicated in the drawings when the band is intended for application to a container that is opened by rotation of a closure in a counterclockwise direction. If the band 10 is intended for application to a container that is opened by rotating a closure in a clockwise direction, the lower ends 19 should be spaced downwardly and leftwardly from the upper ends 18.

The score lines 15 optimally extend through the band 10, although partial score lines extending through less than the entire thickness of the band 10 are also operative. Counterclockwise twisting of the band 10 causes the strips 16 to pivot on lower ends 19 of the score lines 15, thereby tearing the strips 16. Oblique slanting of the score lines 15 and strips 16 provides leverage decreasing the total torque required for opening compared with similar devices relying upon a horizontal array of openings in a tamper-evident band. The oblique slanting arrangement also allows the user's hand to develop some inertia in a counterclockwise direction before the strips actually start to tear.

The score lines 15 in this preferred band 10 each include an indentation 21 beginning at a lower end 19 and extending partway across one of the strips 16. The indentations 21 desirably extend less than halfway across the strips 16. In a particularly preferred embodiment, the indentations 21 extend about one-fourth of the distance across the strips 16. The indentations 21 promote a line of clean separation between the strips 16 and lower portion 12 when torque is applied to the band 10.

Figure 3:
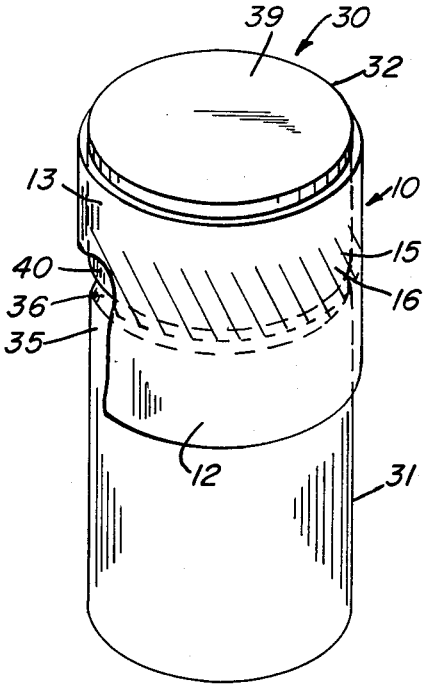
FIG. 3 is a perspective view of a preferred container assembly made in accordance with the invention.
Figure 4:
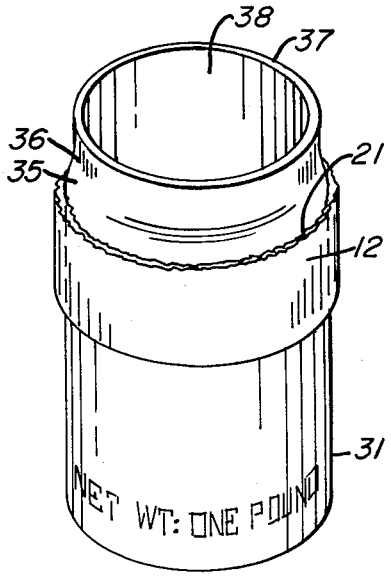
FIG. 4 is a perspective view of the container assembly of FIG. 3, in which the container closure has been removed from the container.

A preferred container assembly 30 of the invention is shown in FIGS. 3 and 4. The container assembly 30 comprises a generally cylindrical container 31, a closure 32, and a temper-indicating band 10. The container 31 has a neck 35 including a finish portion 36 terminating at a rim 37 defining a mouth opening 38 of the container 31. The closure 32 includes a generally flat top portion 39 covering the mouth opening 38 and a skirt 40 engaging the finish portion 36 of the container 31. The closure skirt 40 has internal screw threads (not shown) and is removed from the container 31 by rotation in a counterclockwise direction.

In the preferred embodiment illustrated, an upper portion 13 of the band 10 is adhesively bonded to the closure skirt 40 and a lower portion 12 is similarly bonded to the neck 35 of the container 31. Alternatively, only the lower portion 12 is adhesively bonded to the container neck 35 and no adhesive is applied to the inner surface of the upper portion 13. In this alternative embodiment (not illustrated), the upper portion 13 should substantially cover the exterior of the closure skirt 40. Such construction will make it difficult to remove the closure 32 without removing the upper portion 13 or otherwise visibly wringling or mutilating the band 10.

The array 11 of score lines 15 extends generally horizontally, circumscribing the entire band 10. Although the generally horizontal array 11 illustrated is preferred, the score lines 15 may also be distributed in a wavy or zig zag pattern is desired. The score lines 15 preferably have constant lengths as shown in FIGS. 1, 2 and 3, but their lengths may be varied if an unusual appearance is desired. The score lines 15 are slanted obliquely from the vertical and include indentations 21 extending from the lower ends 19 partway across the strips 16. As shown in FIG. 4, the indentations 21 promote a more even line of separation between the strips 16 and lower portion 12. In the absence of such indentations 21, some of the strips 16 have a tendency to remain attached to the lower portion 12, thereby producing an irregular and less attractive zone of separation.

Figure 5:
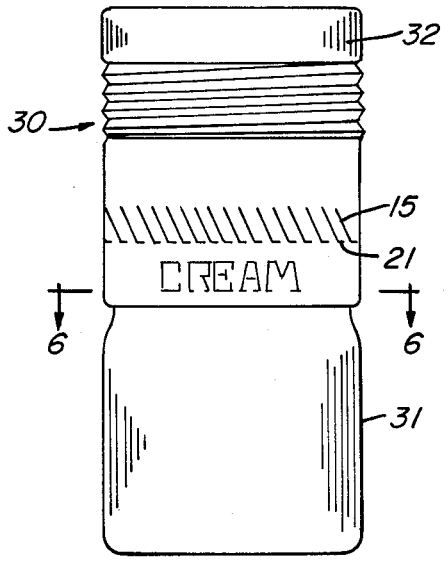
FIG. 5 is a perspective view of an alternative embodiment of a container assembly made in accordance with the invention.
Figure 6:
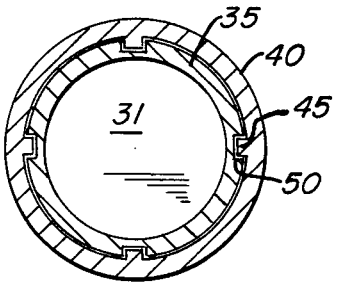
FIG. 6 is a cross-sectional view taken along the lines 6—6 of FIG. 5

An alternative embodiment of the container assembly 30 of the invention is illustrated in FIGS. 5 and 6. The assembly 30 includes a container 31 and a metal closure 32. An array of score lines 15 is formed in the closure skirt 40 and there is no separate "band" connecting the skirt 40 and container neck 35. As shown in FIG. 6, a lower portion of the skirt 40 is provided with several radially inwardly extending tongues or beads 45 locked into corresponding grooves 50 in the container neck 35. When counterclockwise torque is applied to the closure 32, the closure 32 breaks along a line of least resistance defined by indentations 21 at lower ends of the score lines 15.

In the embodiment illustrated, the interlocked beads 45 and grooves 50 fasten the lower portion of the skirt 40 to the container 31. Construction of the assembly 30 can be varied by providing the container neck 35 with projections locking into corresponding openings (not shown) in the skirt 40. The skirt 40 may also be fastened to the container by an adhesive or other preferred fastening means.

With the foregoing detailed description has been made with a preferred embodiment of my invention in mind, numerous changes and modifications will occur to persons skilled in the art without departure from the spirit and scope of the following claims.

What is claimed is:

1. A tamper-indicating band for a container having a neck including a distal finish portion terminating in a rim defining a mouth opening of the container, and a closure overlying the mouth opening and including a skirt engaging the finish portion; said band being formed from paper or foil-covered paper and comprising a single array of obliquely slanted score lines spaced apart from one another, said array extending latitudinally across the entire length of the band and dividing the band into a proximal portion to be fastened to the container and a distal portion to overlie at least a portion of the skirt, said score lines being generally parallel to one another and defining a plurality of obliquely slanted fracturable strips that are uninterrupted by any gaps between adjacent strips; whereby upon fastening said band to the container, said band constitutes a sensitive visual indicator of any attempt to remove the closure.

2. The band of claim 1 wherein said band is generally rectangular.

3. The band of claim 1 wherein said score lines are each spaced apart from one another by a distance of less than about 5 millimeters.

4. The band of claim 1 wherein said score lines are each spaced apart from one another by a distance of about 2 millimeters.

5. The band of claim 1 wherein said score lines are separated by a substantially constant distance.

6. The band of claim 1 wherein said score lines extend through the band.

7. The band of claim 1 wherein said score lines extend through less than the entire thickness of the band.

8. The band of claim 1 wherein said array of score lines extends generally horizontally across the band, each said score lines including an upper end and a lower end spaced downwardly and rightwardly from said upper end.

9. The band of claim 8 wherein at least one of said score lines includes an indentation extending rightwardly of said lower end, each said indentation extending partway across one of said strips.

10. The band of claim 9 wherein each said indentation extends less than halfway across said strips.

11. The band of claim 1 wherein each said score lines includes a distal end and a proximal end spaced proximally of said distal end, at least one end of said scrore lines including an indentation extending from the proximal end less than halfway across a strip.

12. A container assembly providing a sensitive visual indicator of any attempt at tampering and comprising (a) a container having a neck including an upper finish portion terminating at a rim defining a mouth opening of the container, (b) a closure covering the mouth opening and including a skirt engaging the finish portion, and (c) a tamper-indicating band formed from paper or foil-covered paper and comprising a single generally horizontally extending array of score lines slanted obliquely from the vertical, said score lines being generally parallel to one another, said array dividing the band into an upper portion overlying the skirt and a lower portion fastened to the container, said score lines defining a plurality of obliquely slanted fracturable strips that are uninterrupted by any gaps between adjacent strips.

13. The container assembly of claim 12 wherein the upper portion of said band is fastened to the skirt.

14. The container assembly of claim 12 wherein said closure is removed from the container by rotation of the closure in a counterclockwise direction.

15. The container assembly of claim 14 wherein each said score lines includes an upper end and a lower end spaced downwardly and counterclockwise from said upper end.

16. The container assembly of claim 15 wherein at least one of said score lines includes an indentation extending counterclockwise of its lower end, each said indentation extending partway across one of said strips.

17. A container assembly having a closure providing a sensitive visual indicator of any attempt at tampering, said assembly comprising (a) a container having a neck including an upper finish portion terminating at a rim defining a mouth opening of the container, and (b) a closure comprising (1) a top portion covering the mouth opening, and (2) a tamper-indicating skirt extending downwardly from the top portion and comprising a single generally horizontally extending array of score lines, each said score lines being slanted obliquely from the vertical, said array dividing the skirt into an upper portion overlying the finish portion and a lower portion fastened to the container, said score lines being generally parallel to one another and defining a plurality of obliquely slanted, fracturable strips that are uninterrupted by any gaps between adjacent strips, each said score lines including an upper end and a lower end spaced downwardly and rightwardly from said upper end, at least one of said score lines including an indentation extending rightwardly of said lower end and less than halfway across a strip.

* * * * *